US006877498B1

(12) United States Patent
Matsushima et al.

(10) Patent No.: US 6,877,498 B1
(45) Date of Patent: Apr. 12, 2005

(54) OXYGEN SENSOR DETERIORATION DIAGNOSIS APPARATUS

(75) Inventors: Yuhei Matsushima, Tokyo (JP); Toshiki Kuroda, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/918,464

(22) Filed: Aug. 16, 2004

(30) Foreign Application Priority Data

Mar. 26, 2004 (JP) ..... 2004-092621

(51) Int. Cl.[7] ..... F02D 41/00
(52) U.S. Cl. ..... 123/690; 123/672
(58) Field of Search ..... 123/434, 672, 123/690, 703, 674, 679

(56) References Cited

U.S. PATENT DOCUMENTS 5,533,332 A * 7/1996 Uchikawa ..... 60/274

FOREIGN PATENT DOCUMENTS

JP 4-72438 A 3/1992
JP 11-166438 A 6/1999

* cited by examiner

*Primary Examiner*—Bibhu Mohanty
(74) *Attorney, Agent, or Firm*—Sughrue Mion, PLLC

(57) ABSTRACT

An oxygen sensor deterioration diagnosis apparatus includes an oxygen sensor provided in an exhaust system of an internal combustion engine, an air-fuel ratio control unit for controlling an air-fuel ratio, an operation state detection unit for detecting an operation state of the internal combustion engine, an inversion period measurement unit for detecting an inversion period of an output signal of the oxygen sensor, an oxygen sensor deterioration diagnosis unit for performing a deterioration judgment by comparing the inversion period with a previously set judgment period, and a deterioration diagnosis inhibiting unit for inhibiting, when the operation state detection unit detects the operation state of the internal combustion engine having an influence on the inversion period, the measurement of the inversion period in a period of time of the detection.

4 Claims, 8 Drawing Sheets

OXYGEN SENSOR DETERIORATION DIAGNOSIS APPARATUS

BACKGROUND OF THE INVENTION

1. Field of the Invention

The present invention relates to an oxygen sensor deterioration diagnosis apparatus used for air-fuel ratio control of an internal combustion engine and for diagnosing the deterioration of an oxygen sensor installed in an exhaust passage of the internal combustion engine.

2. Description of the Related Art

An oxygen sensor installed in an exhaust system of an internal combustion engine and for detecting an oxygen concentration in an exhaust gas has generally such a structure that both an inner and an outer surfaces of a zirconia element are coated with porous platinum electrodes, detects whether the air-fuel ratio is rich or lean as-compared with the theoretical air-fuel ratio on the basis of the oxygen concentration in the exhaust gas, and transmits a signal to an ECU (Electronic Control Unit). The ECU performs feedback control by proportional/integral control or the like using the signal, and performs the control so that the air-fuel ratio of an air-fuel mixture becomes the theoretical air-fuel ratio.

Since the oxygen sensor used in this way is directly exposed to the exhaust gas, combustion dust or the like in the exhaust gas is attached to and covers the porous surface, or the function of the sensor itself is deteriorated by high temperature, and when the deterioration proceeds, the responsibility to the change of the oxygen concentration is deteriorated. In general, in the case where a fuel injection amount and an intake air amount are constant, the output voltage of the oxygen sensor repeats a change at an almost constant inversion period. However, in the case where the deterioration proceeds, the responsibility is deteriorated, so that the inversion period becomes large, it becomes difficult to control the air-fuel ratio to the theoretical air-fuel ratio, and air pollution substances such as hydrocarbon, carbon monoxide, and nitrogen oxide are increased.

Various devices for diagnosing the deterioration of the oxygen sensor as stated above have been proposed, and a technique disclosed in patent document 1 (JP-A-04-072438) is also one of them. In the technique disclosed in this document, a first oxygen sensor is disposed at the upstream side of an exhaust gas purifying three-way catalyst, a second oxygen sensor is disposed at the downstream side thereof, and feedback control is performed while a control point shift of the feedback control by the output of the first oxygen sensor is corrected by the output of the second oxygen sensor, in which in a case where the responsibility of the first oxygen sensor is deteriorated and the inversion period becomes large, the air-fuel ratio control shift is increased, and the absolute level of an increase/decrease level by the second oxygen sensor is increased, and therefore, the absolute level of this correction value is detected and the deterioration of the first oxygen sensor is diagnosed.

Patent document 2 (JP-A-11-166438) discloses a technique in which an upstream side oxygen sensor is disposed at the upstream side of an exhaust gas purifying three-way catalyst, a downstream side oxygen sensor is disposed at the downstream side thereof, an air-fuel ratio correction coefficient is calculated on the basis of the outputs of the respective sensors to perform air-fuel ratio control, an inversion period of the upstream side oxygen sensor is calculated for a specified period of time or a specified number of times, and when this inversion period is longer than a deterioration value, the oxygen sensor is judged to be deteriorated, wherein an intake air amount of an internal combustion engine is integrated for the specified period of time, and a deterioration judgment value is set in accordance with this integrated value, so that even if a load condition of the internal combustion engine is changed, the deterioration judgment can be properly performed.

As stated above, although the inversion period of the oxygen sensor is detected and the deterioration is judged, since the inversion period of the oxygen sensor is intensely dependent on the change of an operation state of the internal combustion engine, such as a fuel injection amount or an intake air amount, there is a problem that in such an operation state as to influence the inversion period of the oxygen sensor, an erroneous diagnosis is performed so that a normal oxygen sensor is judged to be deteriorated. For example, in the case where the fuel injection amount and the intake air amount are periodically increased/decreased, the inversion period of the oxygen sensor is changed in synchronization with the change, and can become such an inversion period that the oxygen sensor is judged to be deteriorated. Thus, the normal oxygen sensor is erroneously diagnosed as being deteriorated.

Besides, in the deterioration diagnosis apparatus in which in the case where the measurement condition of the inversion period is not established continuously for the specified period of time or longer, the inversion period measured up to that time is made ineffective, when the measured inversion period is made ineffective, the normally measured inversion period is also made ineffective, and therefore, there is a problem that the frequency of deterioration diagnosis is decreased.

SUMMARY OF THE INVENTION

The present invention has been made to solve the foregoing problems, and an object thereof is to provide an oxygen sensor deterioration diagnosis apparatus which can prevent an erroneous diagnosis by inhibiting the monitoring of an inversion period in such an operation state as to influence an inversion period of an oxygen sensor, which can improve the frequency of a deterioration diagnosis by integrating and storing measured inversion periods, and which can improve reliability and frequency in the oxygen sensor deterioration diagnosis.

An oxygen sensor deterioration diagnosis apparatus of this invention includes an oxygen sensor provided in an exhaust system of an internal combustion engine and for outputting a signal corresponding to an oxygen concentration in an exhaust gas, an air-fuel ratio control unit for controlling an air-fuel ratio to a vicinity of a theoretical air-fuel ratio on the basis of an output of the oxygen sensor, an operation state detection unit for detecting an operation state of the internal combustion engine, an inversion period measurement unit for detecting an inversion period of the signal outputted by the oxygen sensor, an oxygen sensor deterioration diagnosis unit for performing a deterioration judgment by comparing, when the operation state of the internal combustion engine detected by the operation state detection unit is a specified operation state, the inversion period of the output signal of the oxygen sensor measured by the inversion period measurement unit with a previously set deterioration judgment period, and a deterioration diagnosis inhibiting unit for inhibiting, when the operation state detection unit detects the operation state of the internal combustion engine having an influence on the inversion period of the output signal of the oxygen sensor, the measurement of the inversion period by the inversion period measurement unit in a period of time of the detection.

Besides, an oxygen sensor deterioration diagnosis apparatus of this invention includes an oxygen sensor provided in an exhaust system of an internal combustion engine and for outputting a signal corresponding to an oxygen concentration in an exhaust gas, an air-fuel ratio control unit for controlling an air-fuel ratio to a vicinity of a theoretical air-fuel ratio on the basis of an output of the oxygen sensor, an operation state detection unit for detecting an operation state of the internal combustion engine, an inversion period measurement unit for detecting an inversion period of the signal outputted by the oxygen sensor, an inversion period integration unit for integrating and storing the inversion period of the output signal of the oxygen sensor measured by the inversion period measurement unit in a period of time when the operation state of the internal combustion engine detected by the operation state detection unit is a specified operation state and for inhibiting the integration of the inversion period in a period of time other than the specified operation state, an inversion period average value calculation unit for calculating an average value of the inversion period from an integration value of the inversion period when an accumulated total of a storage time of the stored inversion period reaches a first specified time, and an oxygen sensor deterioration diagnosis unit for performing a deterioration judgment by comparing the average value of the inversion period with a previously set deterioration judgment period.

According to the oxygen sensor deterioration diagnosis apparatus of this invention, the operation state of the internal combustion engine having the influence on the inversion period of the output signal of the oxygen sensor is detected from, for example, a deviation of filling up efficiency or the like, and the measurement of the inversion period is inhibited in the period of time. Thus, it is possible to prevent such an erroneous diagnosis that a deterioration judgment is made by the detection of increase of the inversion period though the oxygen sensor is normal, and the deterioration diagnosis can be properly performed.

Besides, according to the oxygen sensor deterioration diagnosis apparatus of this invention, the integration of the inversion period is inhibited in the period of time other than the specified operation state, the inversion period of the output signal of the oxygen sensor is measured and integrated only in the period of time of the specified operation state, and the integration value is stored. Thus, even if an improper operation state exists during the measurement, only the period of time of the suitable operation state is selected to measure and accumulate the inversion period, the average value is obtained from the accumulated value, and the appropriateness can be judged. Thus, the monitor frequency is raised and the deterioration diagnosis with high reliability can be performed.

The foregoing and other objects, features, aspects and advantages of the present invention will become more apparent from the following detailed description of the present invention when taken in conjunction with the accompanying drawings.

DETAILED DESCRIPTION OF THE INVENTION

Embodiment 1

Figure 1:
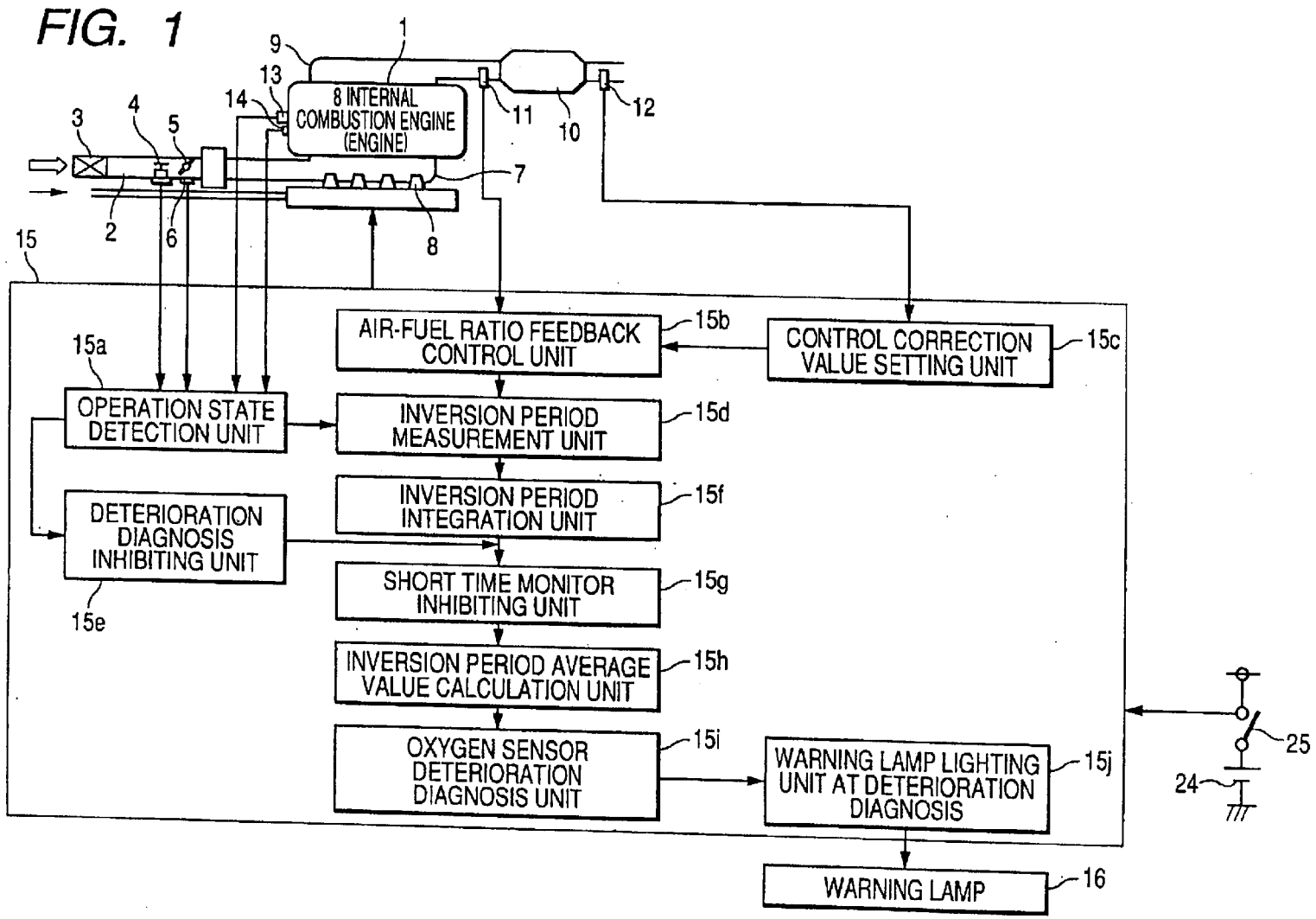
FIG. 1 is a structural view for explaining an oxygen sensor deterioration diagnosis apparatus according to embodiment 1.
Figure 2:
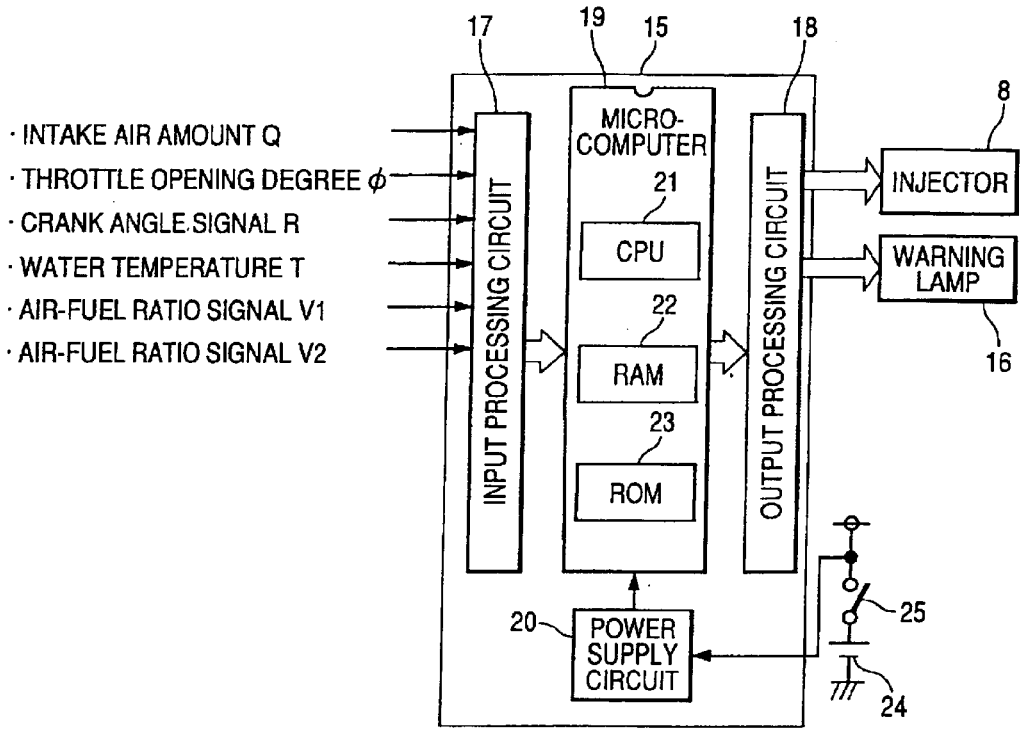
FIG. 2 is an explanatory view for explaining a structure of an ECU of the oxygen sensor deterioration diagnosis apparatus according to embodiment 1.

FIGS. 1 to 8 are views for explaining an oxygen sensor deterioration diagnosis apparatus according to embodiment 1 of this invention. FIG. 1 is a structural view for explaining a rough structure and FIG. 2 is an explanatory view for explaining a structure of an ECU.

Figure 3:
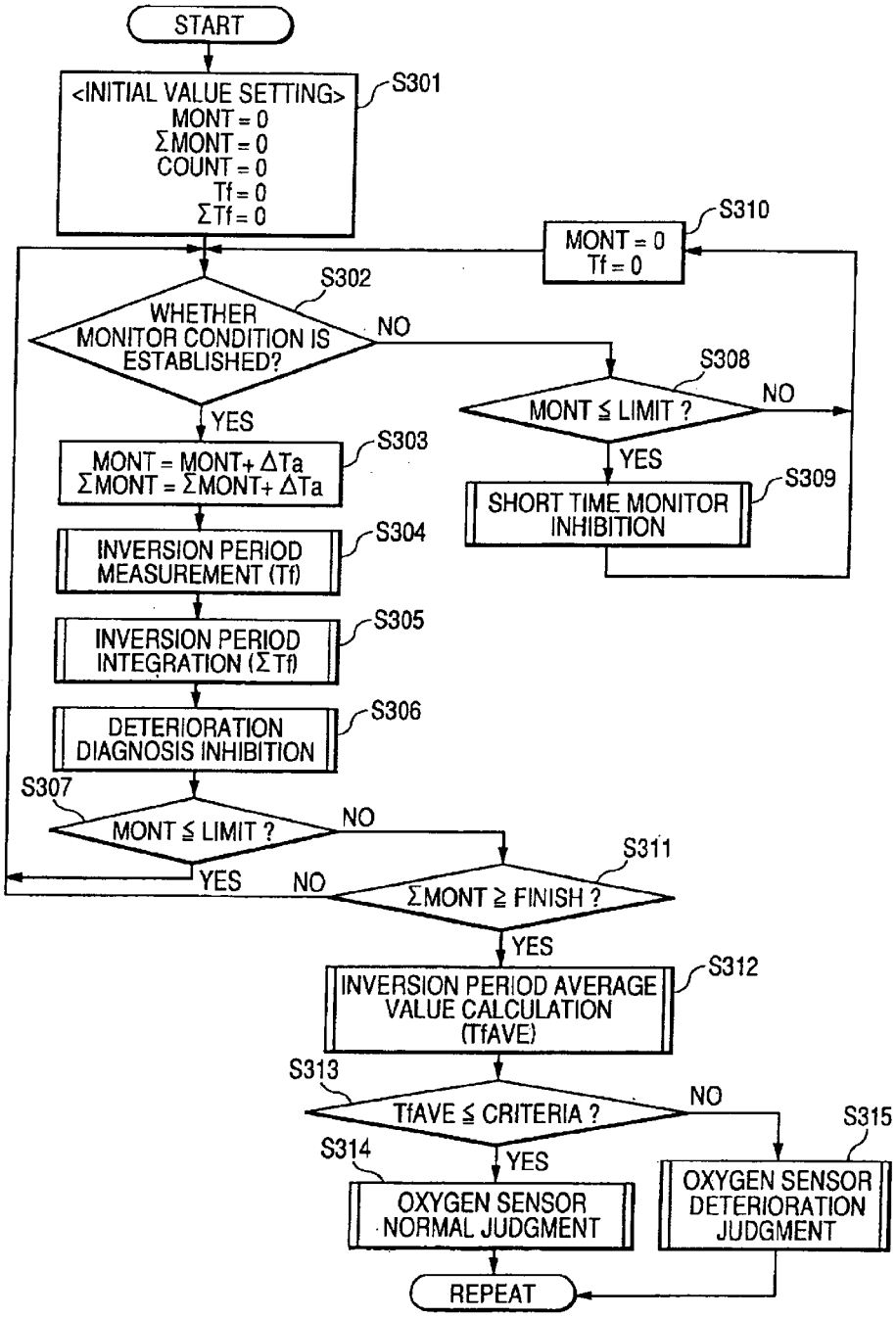
FIG. 3 is a flowchart for explaining a diagnosis processing operation of the oxygen sensor deterioration diagnosis apparatus according to embodiment 1.
Figure 4:
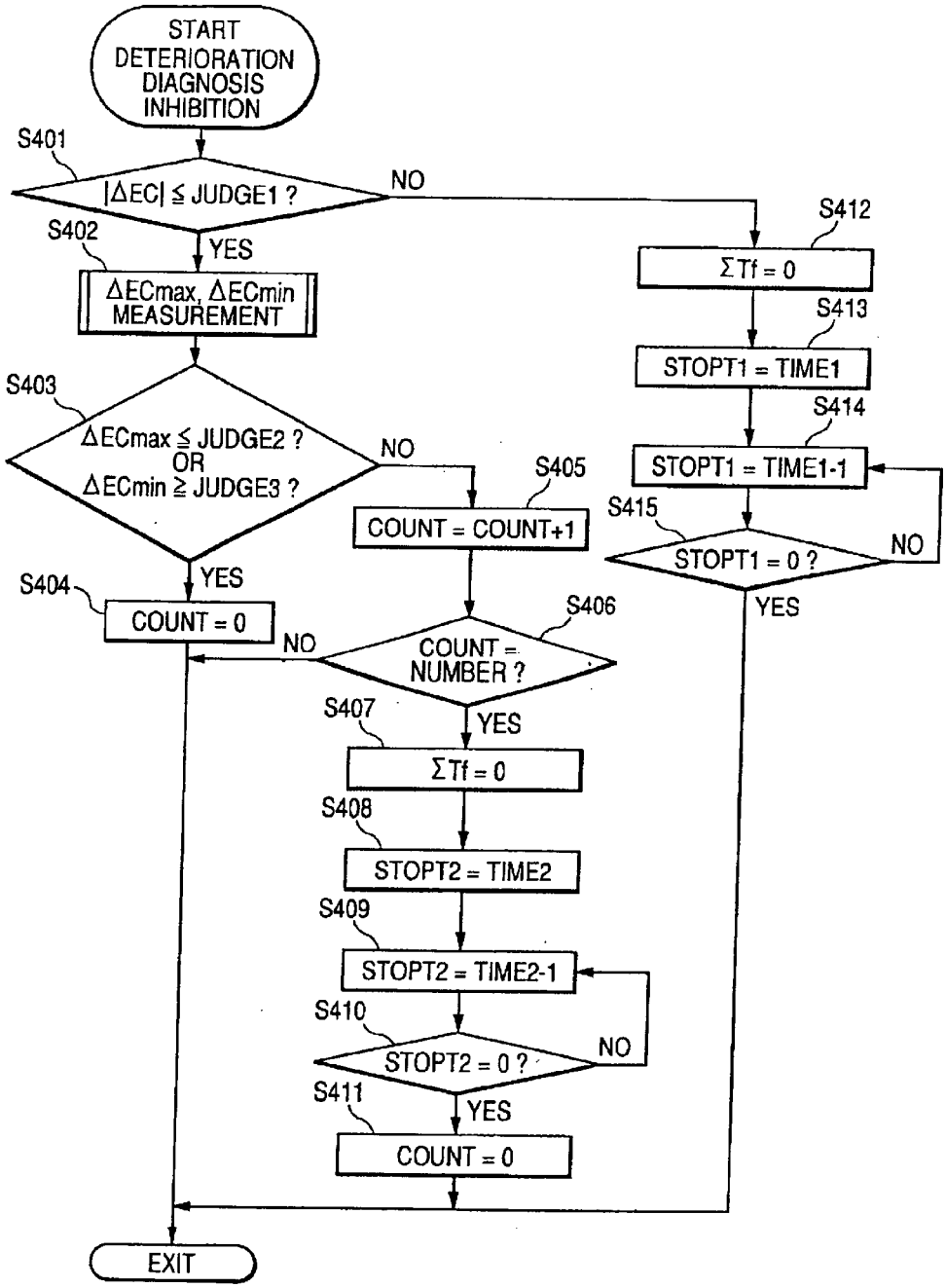
FIG. 4 is a flowchart for explaining an operation of a deterioration diagnosis inhibiting unit of the oxygen sensor deterioration diagnosis apparatus according to embodiment 1.
Figure 5:
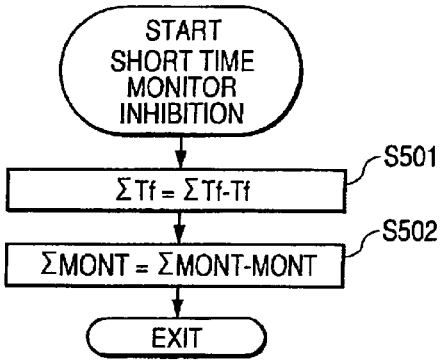
FIG. 5 is a flowchart for explaining an operation of a short time monitor inhibiting unit of the oxygen sensor deterioration diagnosis apparatus according to embodiment 1.
Figure 6:
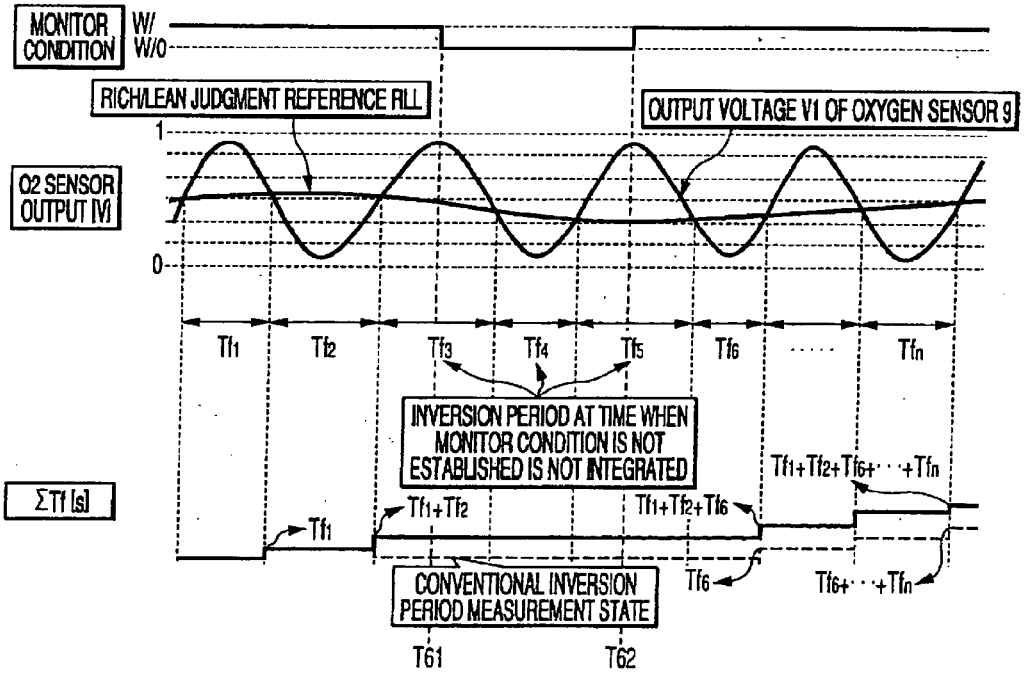
FIG. 6 is a time chart for explaining inversion period measurement and integration of the oxygen sensor deterioration diagnosis apparatus according to embodiment 1.
Figure 7:
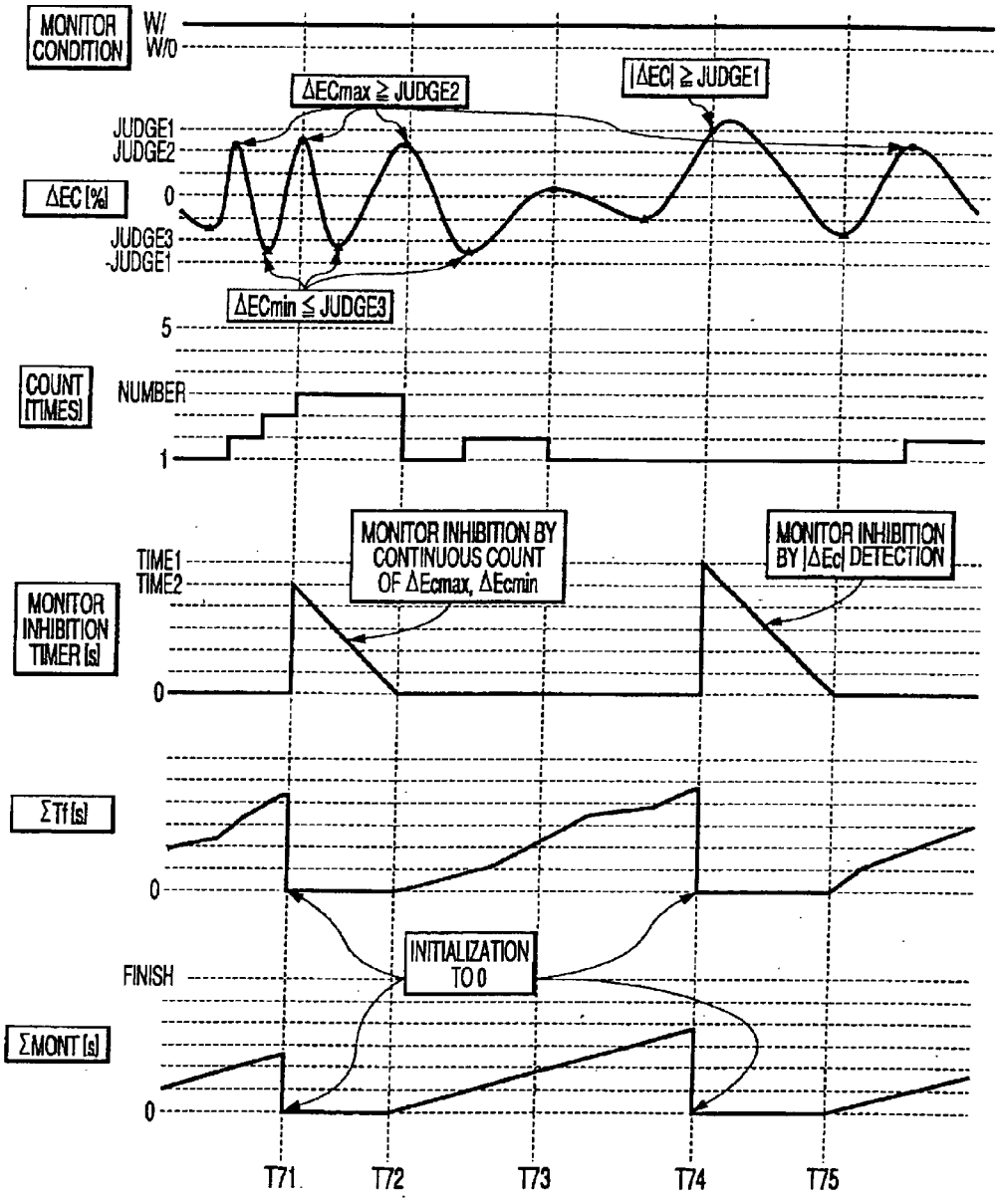
FIG. 7 is a time chart for explaining the deterioration diagnosis inhibiting unit of the oxygen sensor deterioration diagnosis apparatus according to embodiment 1.
Figure 8:
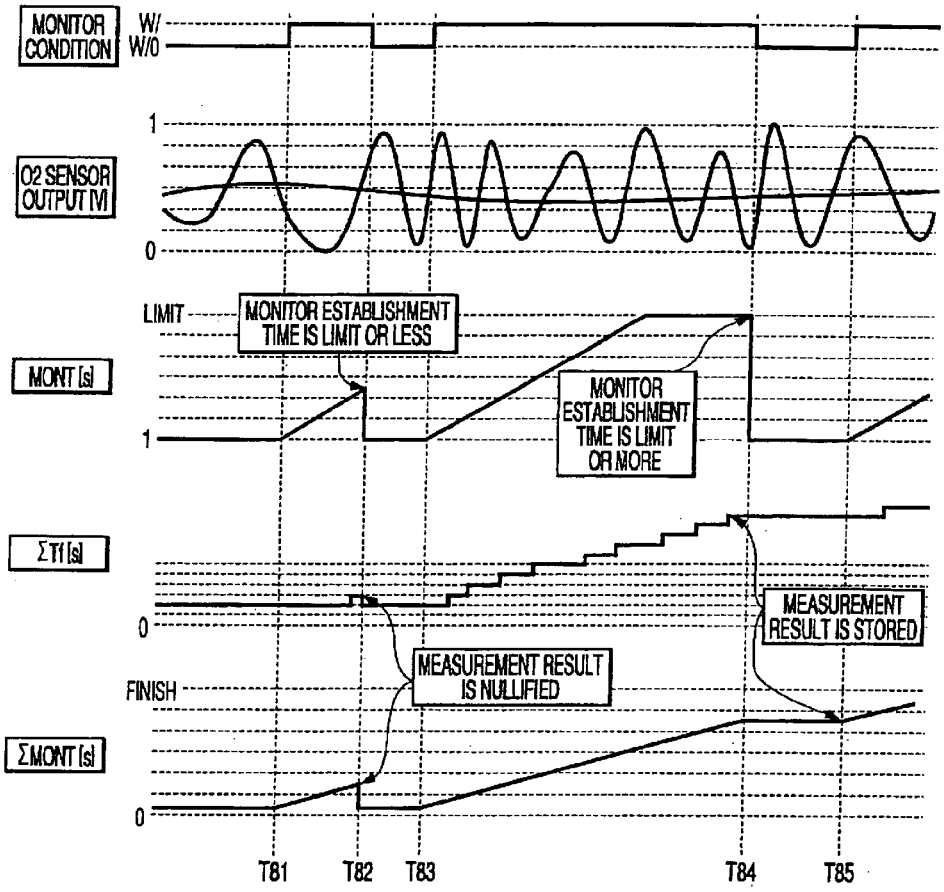
FIG. 8 is a time chart for explaining the short time monitor inhibiting unit of the oxygen sensor deterioration diagnosis apparatus according to embodiment 1.

FIGS. 3 to 5 are flowcharts for explaining an operation of a diagnosis processing, and FIGS. 6 to 8 are time charts for explaining the diagnosis processing.

Figure 9:
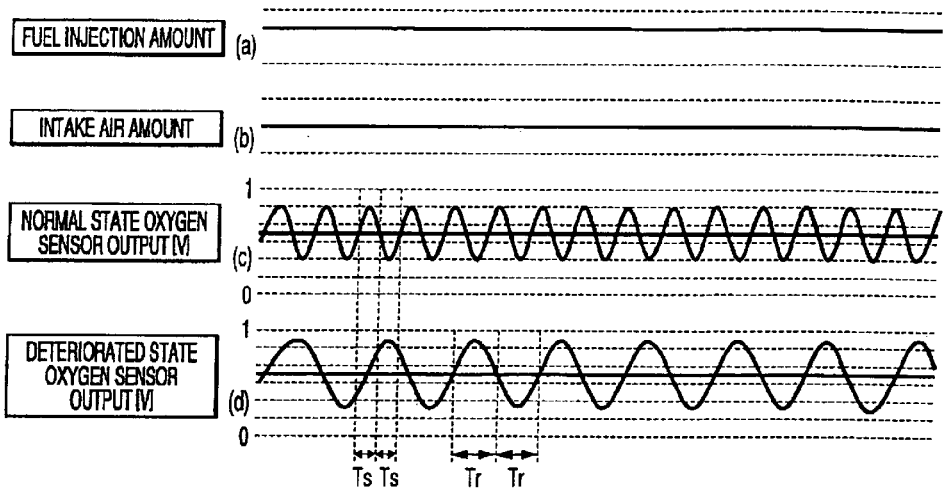
FIG. 9 is an explanatory view for explaining an output of an oxygen sensor.
Figure 10:
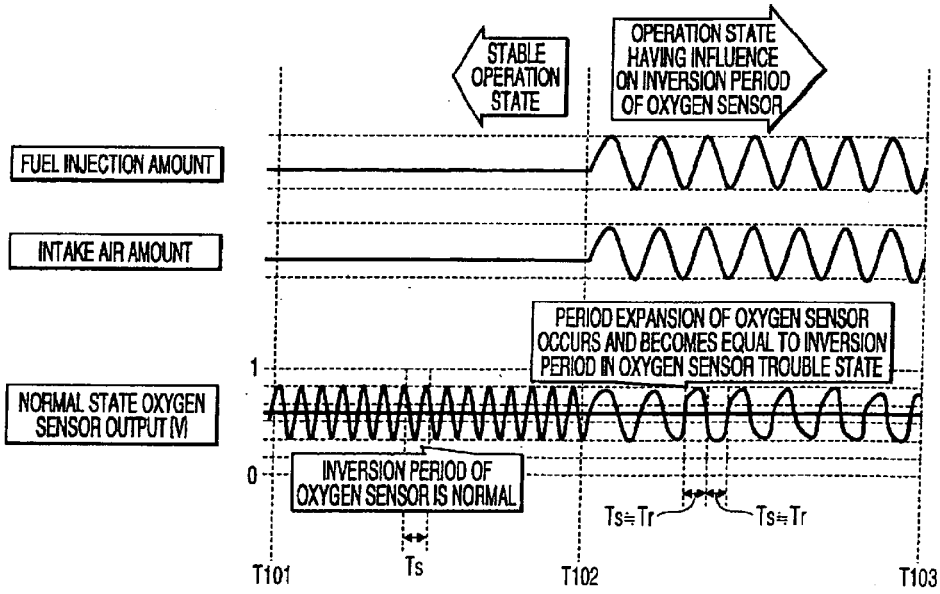
FIG. 10 is an explanatory view for explaining the output of the oxygen sensor.

FIGS. 9 and 10 are explanatory views for explaining an output of an oxygen sensor according to an operation state of an internal combustion engine.

In the structural view of FIG. 1, an air cleaner 3, an air flow meter 4 for measuring an intake air amount, a throttle valve 5 for adjusting the intake air amount, and a throttle sensor 6 for detecting an opening degree of the throttle valve 5 are provided in an intake pipe 2, from its upstream side, for supplying an air-fuel mixture to an internal combustion engine 1 installed in, for example, a vehicle. The intake pipe 2 is connected to the internal combustion engine 1 by an intake manifold 7, and a fuel injection valve 8 is provided at the intake manifold 7 of the intake pipe 2.

A combustion gas (exhaust gas) of the internal combustion engine 1 is discharged into the atmosphere from an exhaust pipe 9. A three-way catalyst 10 for purifying the exhaust gas is disposed in the exhaust pipe 9, an upstream side oxygen sensor 11 is disposed at the upstream side of the three-way catalyst 10, and a downstream side oxygen sensor 12 is disposed at the downstream side thereof. The respective oxygen sensors detect the oxygen concentration in the exhaust gas. A crank angle sensor 13 for detecting a rotation speed and a crank angle, and a temperature sensor 14 for detecting cooling water temperature are provided for the internal combustion engine 1.

As an operation state of the internal combustion engine, a rotation speed R of the internal combustion engine 1 from the crank angle sensor 13, an intake air amount Q from the air flow meter 4, a throttle opening degree $\phi$ from the throttle sensor 6, a cooling water temperature T from the temperature sensor 14, and oxygen concentration signals V1 and V2 from the upstream side oxygen sensor 11 and the downstream side oxygen sensor 12 are inputted to an ECU 15 for controlling the internal combustion engine 1. The ECU 15 drive-controls the fuel injection valve 8 and the like on the basis of these signals.

The upstream side oxygen sensor 11 and the downstream side oxygen sensor 12 detect whether the air-fuel ratio is rich or lean as compared with the theoretical air-fuel ratio on the basis of the oxygen concentration in the exhaust gas, and outputs voltage signals.

The ECU 15 of FIG. 1 shows, as a flow, a function relating to an oxygen sensor deterioration diagnosis in the structure of the ECU 15. An operation state detection unit (means) 15*a* detects the operation state of the internal combustion engine 1 on the basis of the signals from the air flow meter 4, the throttle sensor 6, the crank angle sensor 13, and the temperature sensor 14.

An air-fuel ratio feedback control unit (means) 15*b* receives the voltage signal V1 from the upstream side oxygen sensor 11, operates the fuel injection valve 8, and performs feedback control so that the air-fuel ratio becomes the theoretical air-fuel ratio. A fuel correction value setting unit (means) 15*c* receives the voltage signal V2 from the downstream side oxygen sensor 12, and corrects a control amount of the air-fuel ratio feedback control unit 15*b* according to whether the value of V2 is lean or rich.

In the case where the operation state of the internal combustion engine 1 detected by the operation state detection unit 15*a* is a specified state, an inversion period measurement unit (means) 15*d* measures an inversion period Tf of the output voltage V1 of the upstream side oxygen sensor 11 feedback-controlled as described later. An inversion period integration unit (means) 15*f* integrates the inversion period Tf measured by the inversion period measurement unit 15*d* to obtain an integration value ΣTf.

In the case where the operation state of the internal combustion engine 1 detected by the operation state detection unit 15*a* is not the specified state, that is, it is such an operation state as to influence the inversion period of the upstream side oxygen sensor 11, a deterioration diagnosis inhibiting unit (means) 15*e* detects this and controls to inhibit the oxygen sensor deterioration diagnosis, that is, the measurement of the inversion period Tf.

In the case where an established time of the specified operation state detected by the operation state detection unit 15*a* is within a specified time, a short time monitor inhibiting unit (means) 15*g* inhibits the oxygen sensor deterioration diagnosis, that is, the measurement of the inversion period Tf. An inversion period average value calculation unit (means) 15*h* calculates an average value TfAVE of the inversion period Tf in a period of time when the inversion period Tf is monitored.

When the calculated inversion period average value TfAVE is larger than a previously set trouble judgment threshold CRITERIA, an oxygen sensor deterioration diagnosis unit (means) 15*i* diagnoses the oxygen sensor as being deteriorated, and issues a warning such that a warning lamp lighting unit (means) 15*j* lights a warning lamp 16.

The ECU 15 is constructed of, as shown in FIG. 2, an input processing circuit 17 having functions to perform waveform shaping of analog signals inputted from the respective sensors and to perform digital conversion, an output processing circuit 18 for outputting drive signals to the fuel injection valve 8, the warning lamp 16 and the like, a microcomputer 19, and a power supply circuit 20. The microcomputer 19 is constructed of a CPU 21 for performing the feedback control of the air-fuel ratio on the basis of the input from the respective oxygen sensors 11 and 12 and for performing the deterioration diagnosis, a RAM 22 used as a work memory of the CPU 21, and a ROM 23 in which an operation program and the like of the CPU 21 are stored. The power supply circuit 20 is supplied with electric power from a vehicle battery 24 through a key switch 25 and generates a constant voltage for operating the CPU 21 and the like.

Here, before the description of the operation is made, the output state of the oxygen sensor at the time of deterioration and the operation state of the internal combustion engine having an influence on the inversion period of the output voltage of the oxygen sensor will be described below with reference to FIGS. 9 and 10.

FIG. 9 shows the comparison of output voltages between a normal oxygen sensor and a deteriorated oxygen sensor in the same operation state. In the case where an operation is performed under the condition that a fuel injection amount and an intake air amount are constant as in the drawing, and the air-fuel ratio control is performed, the inversion period of the normal oxygen sensor becomes such as shown in FIG. 9C and the output voltage is changed at an almost constant time Ts.

On the other hand, when the oxygen sensor is deteriorated and the responsibility becomes worse, the output voltage of the oxygen sensor can not follow the change of the oxygen concentration, and as shown in FIG. 9D, the inversion period is changed at Tr larger than Ts at the normal time, air-fuel ratio control accuracy is deteriorated, and pollution substances in the exhaust gas are increased.

FIG. 10 shows a state in which the operation condition of the internal combustion engine is constant from time T101 to time T102, and such an operation condition as to influence the inversion period occurs from time T102 to time T103. The operation state from T102 to T103 is such that the fuel injection amount and the intake air amount are periodically changed.

In the periodically changing operation state as stated above, the inversion period of the oxygen sensor is also changed in synchronization with the change. Thus, although the oxygen sensor is normal and its inversion period should be Ts, the inversion period changes and comes to indicate a value close to Tr, and as a result, the conventional device performs an erroneous judgment that the oxygen sensor is deteriorated, or to the contrary, the deteriorated sensor is not judged to be deteriorated.

The oxygen sensor deterioration diagnosis apparatus of this invention resolves such an erroneous diagnosis. FIG. 3 is a flowchart of the whole structure for performing the deterioration diagnosis to the upstream side oxygen sensor 11 by the ECU 15 constructed as described above, and the processing of this flowchart is repeatedly carried out, for example, every 10 msec.

The deterioration diagnosis processing to the upstream side oxygen sensor 11 is performed by measuring the inversion period of the output voltage V1 of the upstream side oxygen sensor 11 in the feedback control of the air-fuel ratio.

First, at step 301, various conditions such as a counter value and an inversion period are initialized. At step S302, it is judged whether a specified oxygen sensor deterioration monitor condition is established, and the deterioration diagnosis can be performed.

In this judgment, when, for example, the rotation speed R of the internal combustion engine 1, the filling up efficiency EC calculated from this rotation speed R and the intake air amount Q by the air flow meter 4, and the cooling water temperature T by the temperature sensor 14 are within a specified range, and the various conditions relating to the execution of the air-fuel ratio feedback control and activation judgment conditions of the oxygen sensor are all established, it is judged that the monitor condition is established.

When the above monitor condition is established, the procedure proceeds to step S303, and in the case where it is not established, the procedure proceeds to step S308. When the monitor condition is established and the procedure proceeds to step S303, a monitor continuous established time MONT and a monitor established integration time ΣMONT are counted up here, and the procedure proceeds to step S304. At step S304, the inversion period Tf of the output voltage V1 of the upstream side oxygen sensor 11 is measured, and further, the procedure proceeds to step S305, the measured inversion period Tf is integrated, and the integration value ΣTf of the inversion period is calculated.

The details of the inversion period measurement at step S304 and the integration value calculation at step S305 will be described later.

At subsequent step S306, it is judged whether the deterioration diagnosis inhibiting unit 15*e* detects the operation state having an influence on the inversion period of the oxygen sensor, and if detected, the deterioration monitoring of the oxygen sensor is inhibited, and if not detected, the procedure proceeds to step S307. The details of this step S306 will be described later.

At step S307, it is judged whether the monitor continuous established time MONT counted at step S303 is not longer than a maximum inversion period LIMIT (for example, LIMIT=1 sec) of the output voltage V1 of the upstream side oxygen sensor 11, and when the monitor continuous established time MONT is not longer than the maximum inversion period LIMIT, the procedure returns to step S302 and the processing is repeated.

When the monitor condition is not established, the procedure proceeds to step S308, and it is judged whether the monitor continuous established time MONT is not longer than the maximum inversion period LIMIT. When the monitor continuous established time MONT is longer than LIMIT, the monitor continuous established time MONT and the inversion period Tf are initialized to 0 at step S310, the procedure returns to step S302 and the processing is repeated.

At step S308, when the monitor continuous established time MONT is not longer than the maximum inversion period LIMIT, the procedure proceeds to step S309, and the short time monitor inhibiting unit (15*g* of FIG. 1) for invalidating the monitoring in the period of time is put into action. The details of the operation at step S309 will be described later.

When the monitor continuous established time MONT is longer than the maximum inversion period LIMIT at step S307, the procedure proceeds to step S311, and it is judged whether the monitor established integration time ΣMONT is not shorter than a specified monitor time FINISH (for example, FINISH=12 sec). When the monitor established integration time ΣMONT is shorter than the specified monitor time FINISH, the procedure returns to step S302 and the processing is repeated. When the monitor established integration time ΣMONT reaches the specified monitor time FINISH, the procedure proceeds to step S312, the inversion period average value calculation unit (15*h* of FIG. 1) calculates the inversion period average value TfAVE by dividing the inversion period integration value ΣTf by the monitor established integration time ΣMONT.

Subsequently, the procedure proceeds to step S313, and it is judged whether the inversion period average value TfAVE calculated at step S312 is not larger than a previously set deterioration diagnosis threshold value CRITERIA.

When step S313 is established, it is judged at step S314 that the upstream side oxygen sensor 11 is normal, and when step S313 is not established, it is judged at step S315 that the upstream side oxygen sensor 11 is deteriorated, and the oxygen sensor deterioration diagnosis processing is ended.

FIG. 6 is a time chart for explaining the inversion period measurement of the oxygen sensor at step 5304 and the inversion period integration value calculation at step S305.

A rich/lean judgment reference RLL of FIG. 6 is a judgment reference determined according to whether the output voltage V2 of the downstream side oxygen sensor 12 is at the lean side or the rich side. In the measurement of the inversion period at step S304, intervals at which the output voltage V1 of the upstream side oxygen sensor 11 intersects with this rich/lean judgment reference RLL, that is, Tf1, Tf2, . . . , Tfn shown in FIG. 6 are measured as the inversion periods.

In the calculation of the integration value of the inversion period at step S305, in the case where the monitor condition is not established in a period of time from T61 to T62 shown in FIG. 6, the periods of from Tf3 to Tf5 are not integrated, and Tf1 and Tf2 and Tf6 to Tfn are integrated as ΣTf.

FIG. 4 is a flowchart for explaining the operation of the deterioration diagnosis inhibition at step S306 shown in FIG. 3. In this flowchart, first, it is judged at step S401 whether an absolute value |ΔEC| of the filling up efficiency deviation ΔEC (for example, ΔEC is a deviation of the filling up efficiency EC in 0.5 sec) is a specified value JUDGE 1 (for example, JUDGE1=40%) or less.

In the case where the absolute value |ΔEC| of the filling up efficiency deviation ΔEC is larger than the specified value JUDGE1, the procedure proceeds to step S412, and the inversion period integration value ΣTf up to that time is initialized to 0. Subsequently, the procedure proceeds to step S413, a monitor inhibition timer STOPT1 is set to a specified time TIME1 (for example, TIME1=5 sec) here, and at subsequent step S414 and step S415, the monitoring is inhibited until the monitor inhibit timer STOT1 becomes 0 and the processing is ended.

At step S401, in the case where the absolute value |ΔEC| of the filling up efficiency deviation ΔEC is the specified value JUDGE1 or less, the procedure proceeds to step S402, and an amplitude upper limit value ΔECmax of the filling up efficiency deviation ΔEC or an amplitude lower limit value ΔECmin is measured.

Here, the amplitude upper limit value ΔECmax is the value at the time when the filling up efficiency deviation ΔEC is changed from a positive value to a negative value, and the amplitude lower limit value ΔECmin is the value at the time when the filling up efficiency deviation ΔEC is changed from a negative value to a positive value.

Next, the procedure proceeds to step S403, and it is judged whether ΔECmax is a specified value JUDGE2 (for example, JUDGE2=20%) or less, or whether ΔECmin is a specified value JUDGE3 (for example, JUDGE3=−20%) or higher.

In the case where ΔECmax is the specified value JUDGE2 or less, or ΔECmin is the specified value JUDGE3 or higher, a repeat counter COUNT is initialized to 0 at step s404, and the processing is ended.

At step S403, in the case where ΔECmax is larger than the specified value JUDGE2 or ΔECmin is smaller than the specified value JUDGE3, the procedure proceeds to step S405 and the repeat counter COUNT is counted up.

Next, the procedure proceeds to step S406, and when the repeat counter COUNT does not reach the specified number of times NUMBER (for example, NUMBER=3), the processing is ended here, and when the repeat counter at step S406 is the specified number of times NUMBER, the procedure proceeds to step S407, and the inversion period integration value ΣTf up to that time is initialized to 0. Next, the procedure proceeds to step S406, and when the repeat counter COUNT does not reach the specified number of times NUMBER (for example, NUMBER=3), the processing is ended here, and when the repeat counter is the specified number of times NUMBER, the procedure proceeds to step S407, and the inversion period integration value ΣTf up to that time is initialized to 0.

At step S408, a monitor inhibit timber STOPT2 is set to a specified time TIME2 (for example, TIME2=3 sec), the monitoring is inhibited at step S409 and step S410 until the monitor inhibit timer STOPT2 becomes 0, and at step S411, the repeat counter COUNT is initialized to 0 and the processing is ended.

FIG. 7 is a time chart showing the deterioration diagnosis inhibition processing (step S306 of FIG. 3 shown in the flowchart of FIG. 4) in time series data.

In the drawing, when JUDGE2 or more of ΔECmax and JUDGE3 or less of ΔECmin are continued, the repeat counter COUNT counts this, and when the count reaches the specified number of times NUMBER (for example, 3), the monitor inhibition timer STOP2 is set to the specified time TIME2 at time T71, and the monitoring is inhibited between time T71 to time T72. This operation is based on steps S403 and S405 to S411 of FIG. 4.

In FIG. 7, although a point where ΔECmin becomes JUDGE3 or less exists between T72 and T73, the number of times does not reach the specified number of times NUMBER, and ΔECmax is JUDGE2 or less at time T73, and accordingly, the repeat counter COUNT is reset to 0.

This operation is based on step S403 and S404 of FIG. 4. At time T74, because of $|\Delta EC| \geqq$ JUDGE1, the monitor inhibition timer STOPT1 is set to the specified time TIME1, and the monitoring until time T75 is inhibited. This is based on steps S401 and S412 to S415 of FIG. 4.

The flowchart of FIG. 5 shows the operation of the short time monitor inhibition processing of step S309 of FIG. 3. In the drawing, at step S501, the inversion period integration value ΣTf is made a value obtained by subtracting the inversion period Tf from the inversion period integration value ΣTf, and at step S502, the monitor established integration time ΣMONT is made a value obtained by subtracting the monitor continuous established time MONT from the monitor established integration time ΣMONT and the processing is ended. The content of this operation is as described in FIG. 8.

FIG. 8 is a time chart showing the short time monitor inhibition processing (step S309 of FIG. 3) in time series. In the case where the monitor condition is established at time T81 and the monitor condition is not established at T82, since the monitor condition established time is the maximum inversion period LIMIT or less in the period of time between T81 and T82, at the time point of T82 when the monitor condition comes not to be established, the inversion period integration value ΣTf measured up to that time and the monitor established integration time MONT are returned to the values at time T81. This is the operation of the flowchart of FIG. 5.

Next, at time T83, in the case where the monitor condition is established, and this established condition continues until T84, since the monitor condition established time between time T83 and time T84 is the maximum inversion period LIMIT or longer, even after time T84 when the monitor condition comes not to be established, the inversion period integration value ΣTf measured up to that time and the monitor established integration time ΣMONT are stored until T85 when the monitor condition is next established, and when the monitor condition is established at T85, a subsequent inversion period Tf is added to the integration value at the time point of time T84.

As described above, according to this embodiment, in the oxygen sensor deterioration diagnosis apparatus which diagnoses the upstream side oxygen sensor 11 as being deteriorated when the value obtained by dividing the inversion period integration value ΣTf of the output voltage V1 of the upstream side oxygen sensor 11 in the specified period FINISH or longer by the monitor established integration time ΣMONT is larger than the previously determined deterioration diagnosis threshold value CRITERIA, in the case where such an arbitrary operation state as to influence the inversion period Tf is detected during the establishment of the specified monitor condition, the monitoring is inhibited (step S306). Accordingly, such an erroneous diagnosis as to judge the normal oxygen sensor to be deteriorated is not performed, and the oxygen sensor deterioration diagnosis can be properly performed.

In the case (step S312 to S315) where the upstream side oxygen sensor 11 is diagnosed as being deteriorated when the value obtained by dividing the inversion period integration value ΣTf of the output voltage V1 of the upstream side oxygen sensor 11 in the specified period FINISH or longer by the monitor established integration time ΣMONT is larger than the previously set deterioration diagnosis threshold value CRITERIA (step S312 to S315), when the specified monitor condition comes not to be established (step S302), the inversion period integration value ΣTf measured up to that time is not initialized but is stored, and when the monitor condition is again established, the stored inversion period integration value ΣTf is integrated with the inversion period Tf. Thus, the monitor frequency of the oxygen sensor deterioration diagnosis can be improved.

Further, in the case where as the monitor condition, only the maximum inversion period LIMIT or less is established (step S308), the measured inversion period Tf and the inversion period integration value ΣTf are returned to the values immediately before the monitor condition is established (step S308 to S310), and the integration values up to that time are kept. Accordingly, the integration can be continued except for the inversion period when the monitor condition is not established, and the oxygen sensor deterioration diagnosis can be performed properly.

In the above description, although the description has been given of the structure and operation in which the oxygen sensors are provided at both the upstream side and the downstream side, the invention can be applied to a system which includes only an upstream side oxygen sensor. Besides, although the description has been given while the filling up efficiency deviation ΔEC is used for the detection of the operation state having the influence on the inversion period, even when a parameter having an influence on the load change of the internal combustion engine, for example, the intake air amount Q, the throttle opening degree $\phi$, pressure of the intake manifold, or pressure in a cylinder is used, the invention is established.

Further, in the above description, as the specified time when the short time monitoring is inhibited, the maximum inversion period which the upstream side oxygen sensor 11 can take in the range of the monitor condition is set as LIMIT, it may be set relative to the previously set deterioration diagnosis threshold value CRITERIA of the oxygen sensor.

While the presently preferred embodiments of the present invention have been shown and described.

It is to be understood that these disclosures are for the purpose of illustration and that various changes and modifications may be made without departing from the scope of the invention as set forth in the appended claims.

What is claimed is:

1. An oxygen sensor deterioration diagnosis apparatus comprising:

an oxygen sensor provided in an exhaust system of an internal combustion engine and for outputting a signal corresponding to an oxygen concentration in an exhaust gas;

an air-fuel ratio control unit for controlling an air-fuel ratio to a vicinity of a theoretical air-fuel ratio on the basis of an output of the oxygen sensor;

an operation state detection unit for detecting an operation state of the internal combustion engine;

an inversion period measurement unit for detecting an inversion period of the signal outputted by the oxygen sensor;

an oxygen sensor deterioration diagnosis unit for performing a deterioration judgment by comparing, when the operation state of the internal combustion engine detected by the operation state detection unit is a specified operation state, the inversion period of the output signal of the oxygen sensor measured by the inversion period measurement unit with a previously set deterioration judgment period; and a deterioration diagnosis inhibiting unit for inhibiting, when the operation state detection unit detects the operation state of the internal combustion engine having an influence on the inversion period of the output signal of the oxygen sensor, the measurement of the inversion period by the inversion period measurement unit in a period of time of the detection.

2. An oxygen sensor deterioration diagnosis apparatus comprising:

an oxygen sensor provided in an exhaust system of an internal combustion engine and for outputting a signal corresponding to an oxygen concentration in an exhaust gas;

an air-fuel ratio control unit for controlling an air-fuel ratio to a vicinity of a theoretical air-fuel ratio on the basis of an output of the oxygen sensor;

an operation state detection unit for detecting an operation state of the internal combustion engine;

an inversion period measurement unit for detecting an inversion period of the signal outputted by the oxygen sensor;

an inversion period integration unit for integrating and storing the inversion period of the output signal of the oxygen sensor measured by the inversion period measurement unit in a period of time when the operation state of the internal combustion engine detected by the operation state detection unit is a specified operation state and for inhibiting the integration of the inversion period in a period of time other than the specified operation state;

an inversion period average value calculation unit for calculating an average value of the inversion period from an integration value of the inversion period when an accumulated total of a storage time of the stored inversion period reaches a first specified time; and an oxygen sensor deterioration diagnosis unit for performing a deterioration judgment by comparing the average value of the inversion period with a previously set deterioration judgment period.

3. An oxygen sensor deterioration diagnosis apparatus according to claim 1, further comprising a short time monitor inhibiting unit for invalidating a measurement value of the inversion period in a period of time when a continuous time of the specified operation state is a second specified time or less.

4. An oxygen sensor deterioration diagnosis apparatus according to claim 2, further comprising a short time monitor inhibiting unit for invalidating a measurement value of the inversion period in a period of time when a continuous time of the specified operation state is a second specified time or less.

* * * * *